US006026743A

United States Patent [19]

Kloti

[11] Patent Number: 6,026,743

[45] **Date of Patent: *Feb. 22, 2000**

[54] CAN-HOLDING DEVICE FOR HOLDING BEVERAGE CANS FOR PRINTING THEIR SURFACES

[76] Inventor: Albert Kloti, Schillstrasse 9, D-86167 Augsburg, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 09/204,549

[22] Filed: Dec. 3, 1998

[30] Foreign Application Priority Data

Dec. 3, 1997 [DE] Germany ..... 197 53 588

[51] Int. Cl.[7] ..... B41F 17/22

[52] U.S. Cl. ..... 101/40; 101/40.1

[58] Field of Search ..... 101/37, 40, 40.1, 101/43, 44

[56] References Cited

U.S. PATENT DOCUMENTS

| | | | |
|---|---|---|---|
| 2,540,554 | 2/1951 | Shurley | 101/40.1 |
| 3,518,939 | 7/1970 | Donner et al. | 101/40 |
| 3,933,091 | 1/1976 | Von Saspe | 101/40 |
| 4,398,627 | 8/1983 | Saccani | 101/40.1 |
| 4,404,900 | 9/1983 | Ozawa et al. | 101/40 |
| 5,121,827 | 6/1992 | Ribordy | 101/40 |

*Primary Examiner*—John Hilten
*Assistant Examiner*—Amanda B. Sandusky
*Attorney, Agent, or Firm*—Oliff & Berridge, PLC

[57] ABSTRACT

Can-holding device for holding filled beverage cans for printing on their surfaces, consisting of a frame (1) and two jaws (2) displaceable in the axial direction of the beverage can (D)to be held between a closed position (FIG. 2) and an open position (FIG. 1) for gripping the beverage can (D) to be printed at its two ends, with jaws (2) each being pretensioned by a spring (3) into its closed position and with grippers (21, 22) which permit gripping by external opening elements (Z) for optional movement of the jaws into their open position, and with each jaw (2)consisting of a jaw carrier (23) that cooperates with guide (11) on frame (1) and is provided with a gripper (21, 22), and of a jaw body (24) rotatable relative thereto, said body being lockable in a reference rotational position (FIG. 3) on jaw carrier (23), said carrier also being optionally unlockable by the actuation of an unlocking element mounted on jaw (2) by means of an external actuating element (E) from its locked state and then being rotatable freely relative to jaw carrier (23), said body also having on its circumference a slot-shaped recess (26) that extends over a certain radial distance, said recess being located at the top in the reference rotational position of jaw body (24) and permitting the introduction of a can gripper.

11 Claims, 3 Drawing Sheets

CAN-HOLDING DEVICE FOR HOLDING BEVERAGE CANS FOR PRINTING THEIR SURFACES

Printing on beverage cans made of aluminum for beers and lemonade beverages has been known for a long time. The methods and machines used for this purpose are designed to print enormous quantities of beverage cans constantly with printed images that are usually simple and frequently of one color, suitable for mass production of unchanging beer or lemonade varieties from major breweries or beverage manufacturers that produce beverages in cans with can imprints that remain unchanged over long periods of time.

The present invention has nothing to do with such mass production of printed beverage cans.

The goal of the present invention instead is to create the possibility of individual printing of relatively small batches of beverage cans, making it possible to print small lots of filled beverage cans completely individually with advertising or decorative imprints of any kind using single- or multicolor printing, rapidly and economically. This provides larger and smaller companies alike with the ability to use individually printed beverage cans as advertising media at justifiable expense.

For this purpose, the invention provides a can-holding device that makes it possible to print on can surfaces using automatic printing machines, using screen printing for example. The invention assumes that conventional printing methods, which can be used economically only for printing large quantities, are not available for achieving the desired purpose. To print beverage cans in small batches it is advisable not to print on the cans until they have been filled, which poses the problem of holding the filled cans in a suitable fashion for the printing process, firstly in a specific position and secondly in such fashion that the printing process can proceed unimpeded and printing can take place automatically. This set of tasks is taken into account by the can-holding device according to the invention.

The can-holding device according to the invention makes it possible to place the cans to be printed in the can-holding device by means of robot arms or to remove them therefrom.

The can-holding device according to the invention makes it possible in its preferred embodiment, in a printing machine for multicolor printing with a series of printing stations for the individual printing colors arranged in series, to hold the cans in a specific initial rotational position and thus make possible a successive printing of the individual colors in exact register at the individual printing stations.

The can-holding device according to the invention is defined in the attached claims.

One embodiment of the can-holding device according to the invention will now be described in greater detail below with reference to the attached drawings.

Figure 1:
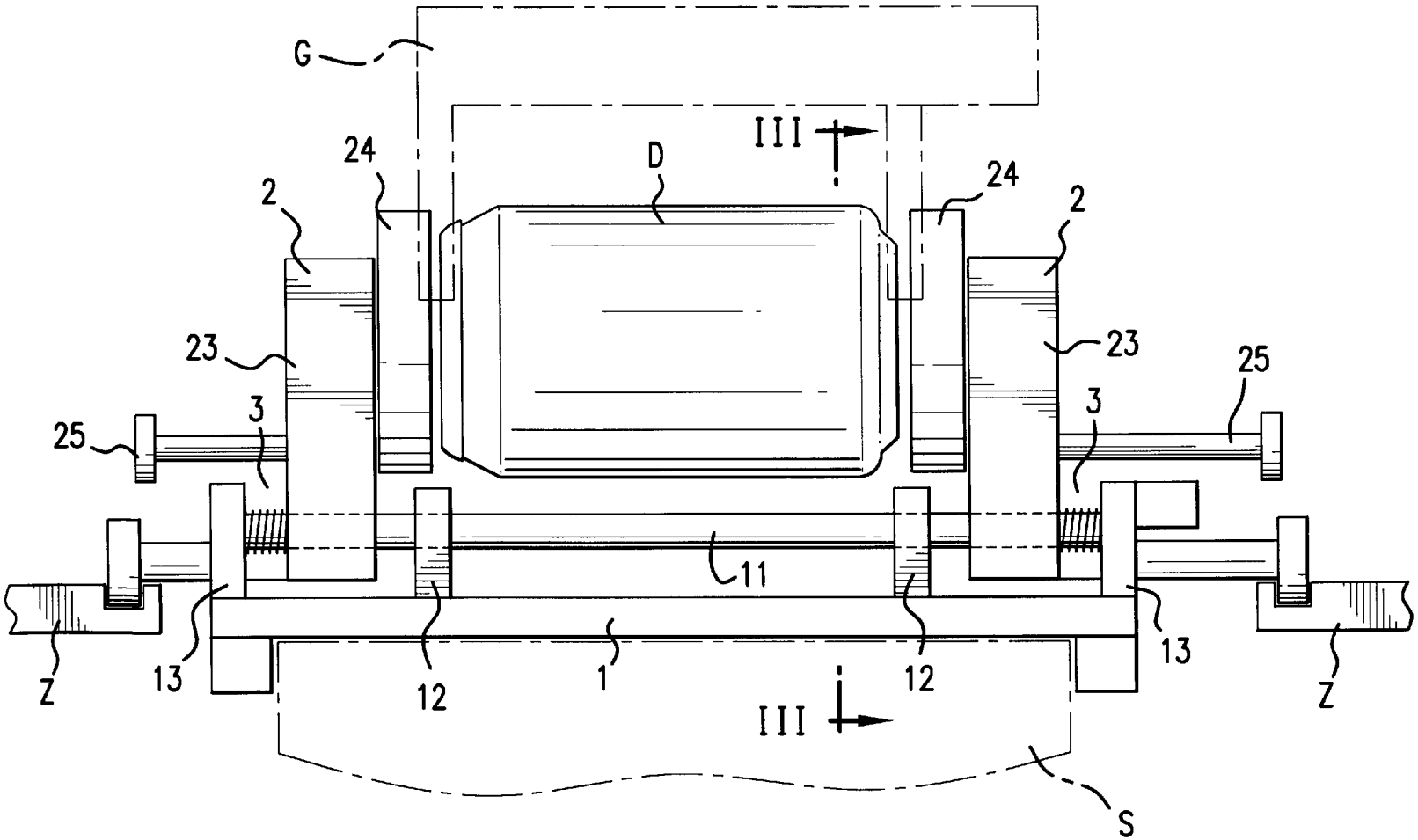
FIG. 1 shows the can-holding device in a side view in the open position for inserting a can to be printed.

The can-holding device according to the invention consists of a supporting frame 1 that can be placed on a transport carriage S indicated schematically and can be removed from the latter, and two jaws located axially opposite one another on frame 1, said jaws serving to grip the can to be printed at both ends.

The two jaws are displaceable on guide rods 11 of the frame between axial limiting stops 12 and 13 and are urged by compression springs 3 into their closed position, in other words the position in which they have approached one another.

Each jaw is provided with an actuating rod 21 with a head 22. Head 22 serves at each can-loading station or can-removal station so that it can be retracted by means of hook-shaped pulling elements Z at the respective stations in order to pull back the two jaws into their open position for inserting or removing a can by means of a gripper G, indicated schematically in FIG. 1 against the force of springs 3.

The ends of jaws 2, as is not shown in particular, are so designed that they abut the ends of the cans or the edges of the ends of the cans at the circumference not only due to the pretensioning forcewise by springs 3 but also by good frictional contact. For this purpose, rings made of a rubber-like or other material that produces good frictional contact can be provided (not shown). This measure is intended to rotate the cans at the printing stations without slipping.

The two jaws 2 each have a jaw carrier 23 guided on guide rods 11, to which carrier the actuating rod 21 is attached, and a jaw body 24 that is rotatable relative to the jaw carrier but can be locked in a reference position, said body abutting the can end in question. To unlock the non-rotatable lock between jaw body 24 and the jaw carrier 23 in question, an actuating rod 25 provided with a head is used that can be engaged and retracted at a printing station by an unlocking element E. The locking mechanism is not shown in detail, for the sake of simplification, since suitable unlocking latch mechanisms are available in the prior art. The jaw body 24 in question is then rotatable relative to jaw carrier 23, with the rotary drive being provided in suitable fashion by the printing station, for example by frictional cooperation with the jaw bodies, and with the surface of the can being printed over its entire circumference. After the printing process, jaw body 24 and jaw carrier 23 are locked in the reference position once again, so that in the case of subsequent printing with another printing color in multicolor printing, printing can take place once again starting at the precisely defined reference position and hence in exact register.

Figure 3:
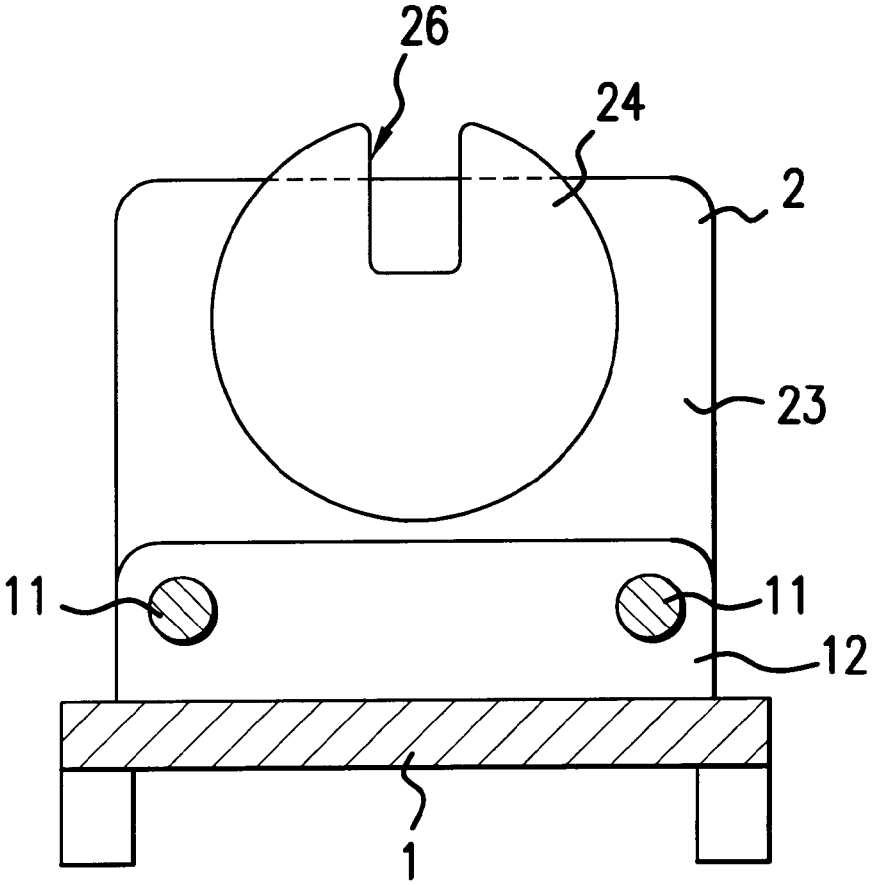
FIG. 3 shows a cross-section along line III—III in FIG. 1. The drawings have been kept very schematic and are intended only to explain the functional principle of the can-holding device without taking unimportant details into account.

It is evident from FIG. 3, in which a jaw body 24 can be seen in an end view, that jaw body 24 has a slot-like recess 26 that is located above relative to its reference rotational position. This recess serves to receive the holding arms of gripper G shown schematically in FIG. 1 when inserting or removing a can, because the gripper, when a can is inserted, must hold onto the can until jaws 2 have moved into their closed position or, when the can is removed, must already have gripped before jaws 2 have moved into their open position.

Figure 2:
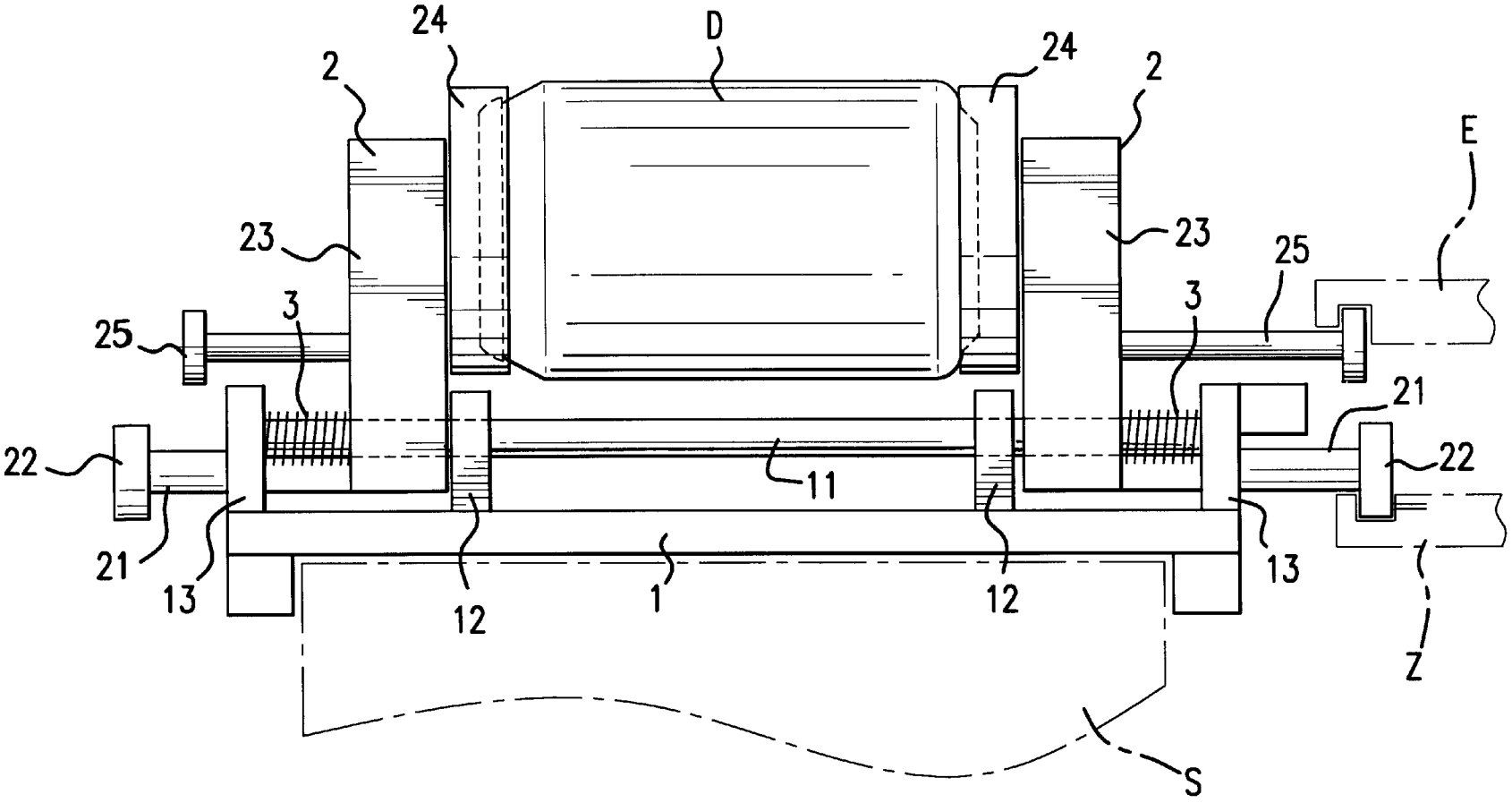
FIG. 2 shows the can-holding device in a closed position holding a can.

In FIG. 3, the two guide rods 11, of which only one is visible in the side view in FIGS. 1 and 2, are both visible.

I claim:

1. Can-holding device for holding a can for printing on a surface of the can comprising a frame and two jaws that are displaceable on the frame in an axial direction of the can between a closed position and an open position the jaws gripping the can at its two ends when in the closed position, each jaw being urged by a spring into the closed positions, each jaw comprising a jaw carrier that cooperates with a guide on the frame and is provided with a gripping structure, which allows gripping by an external opening element for selective movement of the jaws into the open position and a jaw body that is rotatable relative to the jaw carrier, said jaw body being lockable in a reference rotational postion on the jaw carrier, and also being selectively unlockable from its locking state by an external actuator and then being freely rotatable relative to the jaw carrier, each jaw body having a slot-shaped recess on its circumference that extends over a certain radial distance, said recess being located in an upward position when the jaw body is in the reference rotational position and allowing introduction of a can gripper.

2. Can-holding device according to claim 1, wherein the jaw bodies are provided with a coating to increase the friction by which the jaw bodies abut the ends of the can.

3. Can-holding device according to claim 1, wherein the guide on the frame is formed by guide rods on which the jaws are displaceable within areas delimited by axial stops, and wherein pretensioning of the jaws into the closed position is produced by compression springs resting on the guide rods.

4. Can-holding device according to claim 1, wherein the gripping structure on each jaw is formed by a pull rod with a head.

5. Can-holding device according to claim 1, wherein the external actuator is formed by a pull rod with a head.

6. Can-holding device according to claim 2, wherein the guide on the frame is formed by guide rods on which the jaws are displaceable within areas delimited by axial stops, and wherein pretensioning of the jaws into the closed position is produced by compression springs resting on the guide rods.

7. Can-holding device according to claim 2, wherein the gripping structure on each jaw is formed by a pull rod with a head.

8. Can-holding device according to claim 3, wherein the gripping structure on each jaw is formed by a pull rod with a head.

9. Can-holding device according to claim 2, wherein the external actuator is formed by a pull rod with a head.

10. Can-holding device according to claim 3, wherein the external actuator is formed by a pull rod with a head.

11. Can-holding device according to claim 4, wherein the external actuator is formed by a pull rod with a head.

* * * * *